United States Patent [19]

Nishio et al.

[11] Patent Number: 4,859,555

[45] Date of Patent: Aug. 22, 1989

[54] ELECTROPHOTOGRAPHIC PRINTING PLATE COMPRISING DISAZO AND PERYNONE COMPOUNDS, HOLE TRANSPORT MATERIAL AND ALKALI SOLUBLE RESIN

[75] Inventors: Yoshihiro Nishio; Masanobu Nakamura; Midori Fukawatase, all of Saitama; Kenji Takahashi, Tokyo, all of Japan

[73] Assignee: Dainippon Ink & Chemical, Inc., Tokyo, Japan

[21] Appl. No.: 106,843

[22] Filed: Oct. 13, 1987

[30] Foreign Application Priority Data

Oct. 14, 1986 [JP] Japan ..... 61-243769

[51] Int. Cl.[4] ..... G03G 5/06; G03G 5/14

[52] U.S. Cl. ..... 430/72; 430/76; 430/49; 430/300

[58] Field of Search ..... 430/72, 76

[56] References Cited

U.S. PATENT DOCUMENTS 4,435,492 3/1984 Suzuki et al. ..... 430/58

*Primary Examiner*—J. David Welsh

*Attorney, Agent, or Firm*—Armstrong, Nikaido, Marmelstein, Kubovcik & Murray

[57] ABSTRACT

An electrophotographic printing plate comprises a substrate having formed thereon a photoconductive layer comprising (a) a disazo based compound, (b) a perynone based compound, (c) a hole transport material, and (d) an alkali-soluble resin.

8 Claims, 1 Drawing Sheet

ELECTROPHOTOGRAPHIC PRINTING PLATE COMPRISING DISAZO AND PERYNONE COMPOUNDS, HOLE TRANSPORT MATERIAL AND ALKALI SOLUBLE RESIN

BACKGROUND OF THE INVENTION

The present invention relates to an electrophotographic printing plate that has high sensitivity over the entire range of visible light and which is adapted for use in an electrophotographic apparatus, notably in a platemaking system employing projection platemaking system for exposure to visible light, a laser platemaking system employing a gas laser as a light source, or a platemaking system using a light-emitting diode as a light source.

In the art of platemaking processes, active R&D efforts are being made on presensitized (PS) plates since they are lighter in weight, easier to carry and require simpler procedures for platemaking than conventional letterpress and intaglio plates. The technological aspects of the recent investigation of PS plates may be summarized as a capability for easy development, stability under illumination (light stability) and a higher sensitivity. The last-mentioned feature (higher sensitivity) is an objective which researchers are particularly interested to attain because a plate can be directly made from, a highly photoconductive material using an electric signal from a laser. However, most of the photoconductive materials currently used in PS plates of the film contact exposure type employ photochemical reactions and it is said that they must have a maximum sensitivity (i.e., the minimum amount of exposure necessary to form image) of at least 0.1 to 0.5 mJ/cm$^2$. In comparison, no more than a hundredth of this amount of exposure is needed in electrophotographic platemaking processes which record image by making use of photoconductivity, and platemaking systems that employ the electrophotographic process have been introduced in the market.

Image-forming materials employed in such electrophotographic platemaking processes are classified as electrophotographic photoreceptors which are composed of substrates (e.g., metal plates, metal foils and paper) that are rendered hydrophilic by a suitable method such as anodization and which are provided with photoconductive layers having photoconductive materials dispersed in alkali-soluble binder resins. In order to make printing plates from such electrophotographic photoreceptors, they are first subjected to standard procedures of electrophotography, wherein a latent electrostatic image formed is rendered visible by application of an electroscopic toner and the resulting toner image is fixed by either heating or with a solvent vapor. In the next step, the non-image areas of the photoreceptor are washed away with an aqueous alkaline solution in case the toner is insoluble in aqueous alkaline solutions. Commercial organic photoconductors for platemaking currently available include organic dyes (e.g., Elfasol of Kalle A.G.) and organic pigments (e.g., EAC-2 of Polychrome Corporation).

The image recording process and the light source to be used differ depending upon the wavelength range of sensitivity of image-forming materials and their sensitivity. The image-forming materials developed so far have sensitivity in the short range of wavelengths and are unable to utilize exposure light with a very high efficacy. Therefore, in order to form image, they have to be exposed to visible light for a long time or, alternatively, they are exposed by scanning with an argon laser having an oscillation frequency at 488 nm. However, a long exposure time is not only inefficient but also suffering from damage to the original due to a heat or light energy irradiated by the light source. The argon laser requires large power consumption and the laser oscillating tube is relatively short-lived. Therefore, it is difficult to manufacture low-cost platemaking equipment that employs an argon laser as an exposing light source. Intensive studies are, therefore, being conducted in order to extend the wavelength range of sensitivity of photoreceptors to the longer side so that the exposure time can be shortened in platemaking processes and that a He-Ne laser whose oscillating tube has a prolonged life and which requires less power consumption can be used in exposure by laser scanning.

In modern platemaking systems using a He-Ne laser as a light source, photoreceptors are required to have a satisfactory sensitivity (e.g., no more than 5 $\mu$J/cm$^2$ in terms of halftime exposure) at a wavelength of 633 nm. Depending on the type of light source used and its light intensity, sensitivity in projection platemaking system requires the use of photoreceptors having practical halftime exposures of no more than 10 lux.sec. In platemaking from PS plates, it is common practice to expose many images separately on the plate surface or to expose a predetermined number of plates before they are transferred to a development station, so a certain mechanism is required that enables the operator to readily distinguish the exposed areas from the unexposed areas on the image wise exposed PS plate. In electrophotographic platemaking process that involves the formation of a toner image and the use of an alkali solution to wash away the non-image areas where no toner particles have been deposited, it is required that the toner image on the photoreceptor to be treated with an alkali solution should be clearly visible to the operator.

The image-forming materials that have been reported in the literature for use in electrophotographic platemaking processes are chiefly those which employ copper phthalocyanine compounds as photoconductive materials. However, because of the high optical density produced on the photoreceptor as a result of light absorption by phthalocyanine compounds, the reported image-forming materials have low contrast with the toner image, yielding a very low image visibility. As a further problem, the residual potential in the exposed areas is high enough to cause frequent fogging of the toner image.

For the purpose of producing image of improved quality in electrophotography, liquid developers are preferred over powder developers that are less efficient in achieving high resolution. But the stability of electrophotographic systems is also governed by the stability of developers as exemplified by dispersion stability and charge stability. Systems preferred in this respect are those which employ developers that retain stable positive charges and in order to use such developers, a negatively chargeable photoreceptor is necessary. The phthalocyanine compounds known in the art can be used to make positively chargeable photoreceptors but no negatively chargeable photoreceptors having high performance have yet been produced using such phthalocyanine compounds.

SUMMARY OF THE INVENTION

An object, therefore, of the present invention is to provide an electrophotographic printing plate useful as a negatively chargeable photoreceptor that has high sensitivity over the entire range of visible light, forms a highly visible toner image, and which is alkali-soluble in non-image areas.

This object of the present invention can be attained by an electrophotographic printing plate that has formed on a substrate a photoconductive layer comprising (a) a disazo based compound, (b) a perynone based compound, (c) a hole transport material, and (d) an alkali-soluble resin.

DETAILED DESCRIPTION OF THE INVENTION

Figure 1:
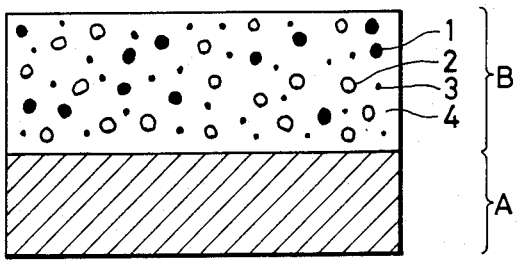
FIG. 1 is a schematic cross section of an electrophotographic printing plate according to one embodiment of the present invention.

The disazo based compound used in the present invention may be selected from among the following compounds:

(1) a compound represented by general formula (I):

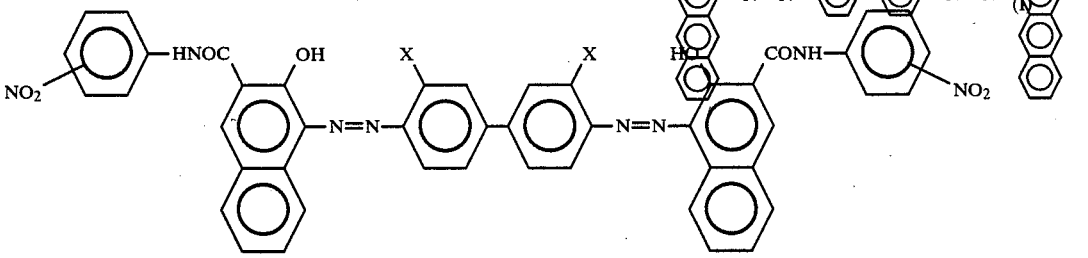

wherein X is a group or an atom selected from among H, $CH_3$, $OCH_3$, Cl and Br;

(2) a compound represented by general formula (II):

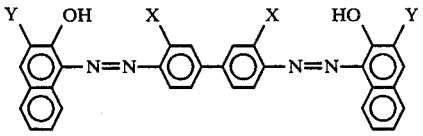

(II)

where Y is a group selected from those which are represented by the following general formulae:

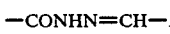

(A)

-continued

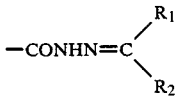

(B)

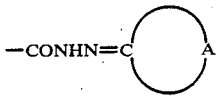

(C)

X is a group or an atom selected from the group consisting of H, $CH_3$, $OCH_3$, Cl, Br and $NO_2$; in formula (A), Ar is a group selected from the group consisting of phenyl, naphthyl, anthryl, pyridyl, thienyl, furyl and carbazolyl groups which may be substituted; in formula (B), $R_1$ and $R_2$ each independently represents an optionally substituted alkyl or aryl group; in formula (C), A C= is an optionally substituted cyclic hydrocarbon group or heterocyclic group;

(3) a compound represented by general formula (III):

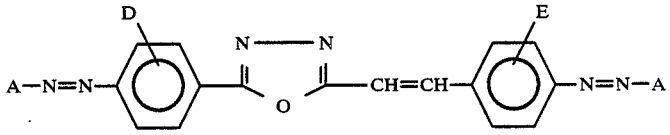

(III)

where A is a coupler having aromatically; D and E each independently represents an atom or a group selected from the group consisting of a hydrogen atom, a halogen atom, a lower alkyl group and a lower alkoxyl group;

(4) a compound represented by general formula (IV):

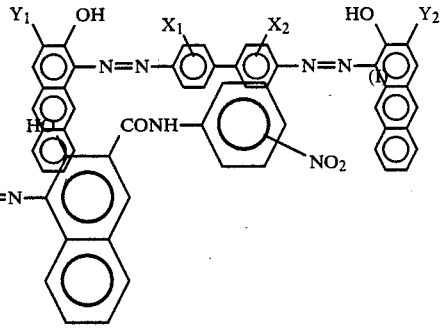

(IV)

where $X_1$ and $X_2$ each independently represents an atom or a group selected form the group consisting of a hydrogen atom, a halogen atom, an alkyl group, an alkoxyl group and a nitro group; $Y_1$ and $Y_2$ each independently represents a group selected from among those having the following generally formulae:

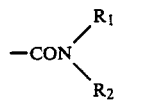
(A)

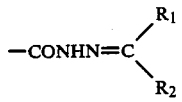
(B)

in formulae (A) and (B), $R_1$ and $R_2$ each independently represents an atom or a group selected from the group consisting of hydrogen atom, a substituted or unsubstituted alkyl group, a substituted or unsubstituted cyclic hydrocarbon group, and a substituted or unsubstituted heterocyclic group; $R_1$ and $R_2$ may combine together to form a ring; and (5) a compound represented by general formula (v):

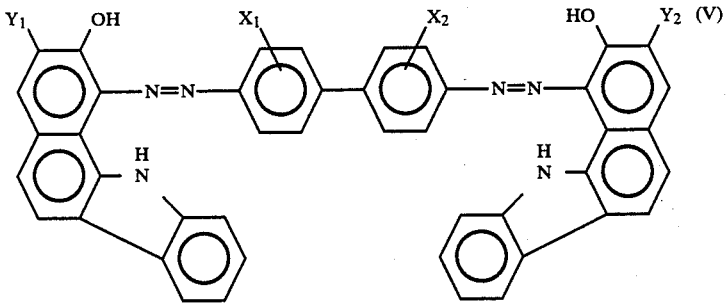
(V)

where $X_1$ and $X_2$ each independently represents an atom or a group selected from the group consisting of a hydrogen atom, a halogen atom, an alkoxyl group and a nitro group; $Y_1$ and $Y_2$ each independently represents a group selected from those which are represented by the following general formulae:

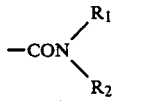
(A)

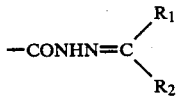
(B)

in formulae (A) and (B), $R_1$ and $R_2$ each independently represents a hydrogen atom, a substituted or unsubstituted alkyl group, a substituted or unsubstituted cyclic hydrocarbon group, and a substituted or unsubtituted heterocyclic group; $R_1$ and $R_2$ may combine together to form a ring. An example of the perynone based compound that is used in the present invention is represented by the following formula:

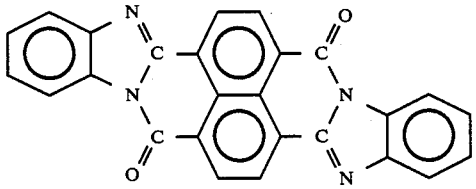

Any of the hole transport materials that are known in the art for use in electrophotographic materials may be used in the present invention. Advantageous hole transport materials include: oxadiazole compounds such as 2,5-bis(4-dimethylaminophenyl)-1,3,4-oxadiazole, 2,5-bis(4'-diethyl-aminophenyl)-1,3,4-oxadiazole, 2,5-bis(4'-aminophenyl)-5-phenyl-1,3,4-oxadiazole, 2-(4'-aminostyryl)-5-(4''-methylphenyl)-1,3,4-oxadiazole; N-alkylcarbazole compounds such as N-methylcarbazole, N-ethylcarbazole and N-propylcarbazole; dialkylaminobenzoic acid compounds such as dimethylaminobenzoic acid, diethylaminobenzoic acid and dipropylaminobenzoic acid; and indole compounds such as 2-methylindole, 3-methylindole, 2-ethylindole, 2-phenylindole, 3-indoleacetone and indoxole. Particularly advantageous compounds are oxadiazole compounds and N-alkylcarbazole compounds. Most advantageous materials are 2,5-bis(4'-diethylaminophenyl)-1,3,4-oxadiazole and N-ethylcarbazole.

Illustrative alkali-soluble resins that can be used in the present invention include: styrene-maleic acid copolymers; and copolymers of polymerizable monomers (e.g., acrylate ester monomers, methacrylate ester monomers, vinyl acetate monomers, styrene monomers and vinyl chloride monomers) with carboxyl-containing polymerizable monomers (e.g., acrylic acid, methacrylic acid, maleic acid, fumaric acid and itaconic acid), or with polymerizable monomers having an acid anhydride structure such as maleic anhydride.

The photoconductive layer of the printing plate of the present invention comprises (a) the disazo based compound, (b) the perynone based compound and (c) the hole transport material, which are dispersed in the alkali-soluble resin. The particles of the three components, (a), (b) and (c), may be directly dispersed in the alkali-soluble resin. If desired, these particles may be further reduced in size by suitable mechanical means (e.g., attritions, sand mills, and ball mills) and this is effective not only for the purpose of improving the dispersion of these particles in a coating of photoconductive material but also for producing a highly charge-receptive printing plate.

The electrophotographic printing plate of the present invention may be prepared by the following procedures: finely divided particles of the components (a) to (c) are added to a solution of the alkali-soluble resin dissolved in a suitable organic solvent, and the resulting mixture is worked with a common dispersing machine (e.g., a ball mill, paint shaker, attritor or a sand mill) to make a uniform dispersion, which is then coated on an electroconductive substrate and dried. Coating of the dispersion may be effected with a conventional machine such as a roller coater, a wire bar, or a doctor blade.

Suitable solvents include: aromatic hydrocarbons such as benzene and toluene; ketones such as acetone and butanone; halogenated hydrocarbons such as methylene chloride and chloroform; ethers such as ethyl ether; cyclic ethers such as tetrahydrofuran and dioxane; and esters such as ethyl acetate and Methyl Cellosolve® acetate. These solvents may be used either alone or in combination.

The photoconductive layer preferably has a thickness of 1 to 50 μm, more preferably 2 to 15 μm.

The disazo based compound (a) and the perynone based compound (b) are preferably used in the photoconductive layer in such amounts that each of them occupies 0.1 to 90 wt % of the alkali-soluble resin. More preferably, they occupy 0.2 to 90 wt % of the alkali-soluble resin. The diazo based compound (a) is preferably used in an amount ranging from 0.1 to 90 wt %, more preferably 0.2 to 50 wt %, of the perynone based compound (b). The hole transport material (c) is preferably used in an amount ranging from 0.1 to 90 wt %, more preferably 1 to 80 wt %, of the alkali-soluble resin.

The support or substrate of the printing plate of the present invention may be made of a metal (e.g., aluminum) plate or foil, a plastic film vapor-deposited with a metal (e.g., aluminum), or paper that has been rendered electroconductive. These substrates or supports are used after being rendered hydrophilic.

The photoreceptor thus prepared may optionally have an adhesive layer or a barrier layer provided between the conductive support and the photoconductive layer. Such an adhesive and a barrier layer may be formed of any appropriate material such as polyamide, nitrocellulose, case in or polyvinyl alcohol.

An example of the electrophotographic printing plate prepared by the method described above is shown schematically in FIG. 1, in which the conductive support (A) that has been rendered hydrophilic is overlaid with the photoconductive layer (B) which has the disazo based compound (1), perynone based compound (2) and the hole transport material (3) dispersed in the alkali-soluble resin (4).

The present invention is hereinafter described with reference to examples but it should be understood that other examples may be conceived without departing from the scope of the present invention. Unless otherwise noted, all "parts" in the following examples are "part by weight".

EXAMPLE 1

A mixture of 50 parts of a disazo based compound of formula (A) (see below), 150 parts of a perinone based compound of formula (B) (see below), 150 parts of an oxadiazole compound of formula (C) (see below) and 650 parts of an alkali-soluble resin (RESYN 28-2930, trade name of National Starch and Chemical Corporation for a carboxylated polyvinyl acetate resin; Mw=20,000) in a mixed solvent of methyl ethyl ketone and Methyl Cellosolve® was worked with a paint shaker to form a uniform dispersion.

(A)

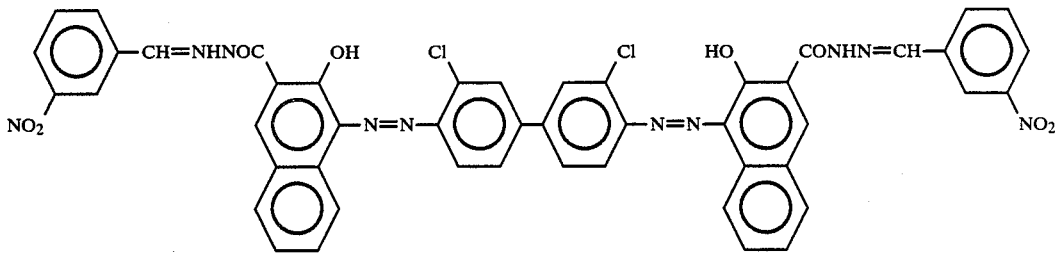

(B)

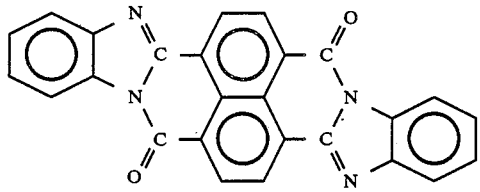

(C)

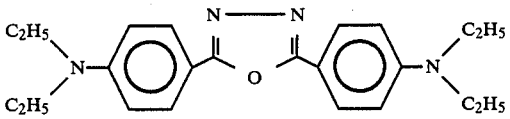

The resulting paint was coated on an anodized aluminum plate with a wire bar and dried to prepare a photoreceptor having a photoconductive layer 5 μm thick. The charging characteristics and light sensitivity of the so prepared electrophotographic printing plate were measured with a Paper Analyzer PS-428 (Kawaguchi Electric Works Co., Ltd.) by the following procedures.

A negative voltage of 6 kilovolts was applied to the surface of the printing plate and its surface potential $V_O$ (V) was measured immediately after voltage application. Ten seconds after the cessation of voltage application, the surface potential $V_{10}$ (V) of the plate was measured. The charge retaining ability of the plate was evaluated in terms of $V_{10}/V_0$.

The charged plate was exposed under a tungsten lamp serving as a white-light source and the sensitivity of the printing plate was evaluated by measurements of the following physical quantities: $E_{\frac{1}{2}}$ (lux.sec), the amount of exposure (intensity, 5 lux) necessary for the surface potential on the exposed plate to drop to half its initial value; $E_{1/10}$ (lux.sec), the amount of exposure (intensity, 5 lux) necessary for the surface potential on the exposed plate to drop to a tenth of its initial value;

$V_{R15}$ (V), the surface potential measured 15 seconds after the start of exposure; and $E_{\frac{1}{2}}$ ($\mu J/cm^2$), light sensitivity or the amount of exposure to spectral light (630 nm; intensity, 10 mW./$m^2$) necessary for the surface potential on the exposed plate to drop to half its initial value. The sensitivity of the plate was evaluated in terms of these physical quantities. The results are summarized in Table 1.

The reflection density of the photoconductive layer on the printing plate was measured with a Macbeth RD 918 (Macbeth Corporation) in order to evaluate the visibility of a toner image to be formed. The results are also shown in Table 1.

TABLE 1

| $V_0$ (V) | $V_{10}$ (V) | $V_{10}/V_0$ | $E_{1/2}$ (lux · sec) | $E_{1/10}$ (lux · sec) | $E_{1/2}$ at 630 nm ($\mu J/cm^2$) | $V_{R15}$ (V) | Reflection density |
|---|---|---|---|---|---|---|---|
| −340 | −316 | 0.93 | 6.0 | 10.0 | 3.0 | 0 | 1.20 |

COMPARATIVE EXAMPLES 1 TO 3

Using the formulations shown in Table 2, printing plates were prepared by the same method as employed in Example 1. The results of measurement of their characteristics are summarized in Table 3.

TABLE 2

| Comparative Example No. | Disazo compound of formula (A) | Perynone compound of formula (B) | Oxadiazole compound of formula (C) | Alkali-soluble resin, "RESYN 28-2930" | Methyl ethyl ketone/Methyl Cellosolve mixed solvent |
|---|---|---|---|---|---|
| 1 | — | 150 parts | 150 parts | 700 parts | 5,600 parts |
| 2 | 50 parts | — | 150 parts | 800 parts | 5,600 parts |
| 3 | 50 parts | 150 parts | — | 800 parts | 5,600 parts |

TABLE 3

| Comparative Example No. | $V_0$ (V) | $V_{10}$ (V) | $V_{10}/V_0$ | $E_{1/2}$ (lux · sec) | $E_{1/10}$ (lux · sec) | $E_{1/2}$ ($\mu J/cm^2$) at 630 nm | $V_{R15}$ (V) | Reflection density |
|---|---|---|---|---|---|---|---|---|
| 1 | −330 | −297 | 0.90 | 25.0 | 53.0 | 52.0 | 25 | 0.57 |
| 2 | −341 | −303 | 0.89 | 15.0 | 47.0 | 10.0 | 18 | 1.78 |
| 3 | −326 | −303 | 0.93 | 90.0 | 30.0 | 25.0 | 25 | 1.21 |

EXAMPLE 2 AND COMPARATIVE EXAMPLES 4 TO 6

Figure 2:
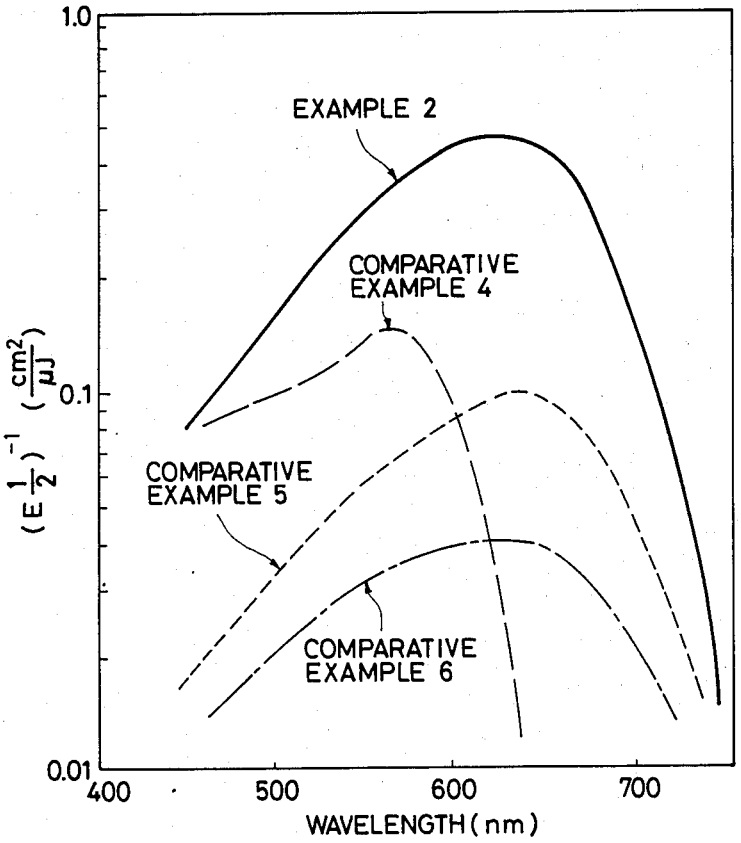
FIG. 2 is a graph showing the spectral sensitivity characteristics of the printing plates prepared in Example 2 of the present invention and in Comparative Examples 4, 5 and 6.

The procedures of Example 1 and Comparative Examples 1 to 3 were repeated except that measurements of halftime exposure $E_{\frac{1}{2}}$) were conducted not with white light but with monochromatic light (half width, 10 nm) extracted by the combination of an interference filter and a bandpass filter. The spectral sensitivity characteristics of the printing plates are plotted in FIG. 2, in which the reciprocal of $E_{178}$ (energy of half decay potential) is used as a measure of sensitivity.

EXAMPLES 3 TO 5

Using the formulations noted in Table 4, printing plates were prepared by the same method as employed in Example 1. The results of measurement of their characteristics are summarized in Table 5.

TABLE 4

| Example No. | Disazo compound of formula (A) | Perynone compound of formula (B) | Oxadiazole compound of formula (C) | Alkali-soluble resin, "RESYN 28-2930" | Methyl ethyl ketone/Methyl Cellosolve mixed solvent |
|---|---|---|---|---|---|
| 3 | 10 parts | 150 parts | 150 parts | 690 parts | 5,600 parts |
| 4 | 30 parts | 150 parts | 150 parts | 670 parts | 5,600 parts |
| 5 | 75 parts | 150 parts | 150 parts | 625 parts | 5,600 parts |

TABLE 5

| Example No. | $V_0$ (V) | $V_{10}$ (V) | $V_{10}/V_0$ | $E_{1/2}$ (lux · sec) | $E_{1/10}$ (lux · sec) | $E_{1/2}$ at 630nm ($\mu J/cm^2$) | $V_{R15}$ (V) | Reflection density |
|---|---|---|---|---|---|---|---|---|
| 3 | −340 | −313 | 0.92 | 10.0 | 17.0 | 5.0 | 0 | 0.95 |
| 4 | −345 | −324 | 0.94 | 8.0 | 12.0 | 3.2 | 0 | 1.15 |
| 5 | −344 | −320 | 0.93 | 5.5 | 9.0 | 2.0 | 0 | 1.35 |

EXAMPLES 6 AND 7

Printing plates were prepared as in Example 1 except that 2,5-bis(4'-diethylaminophenyl)-1,3,4-oxadiazole was replaced by the hole transport materials identified in Table 6. The results of measurement of the plate characteristics are also shown in Table 6.

TABLE 6

| Example No. | Hole transport material | $V_0$ (V) | $V_{10}$ (V) | $V_{10}/V_0$ | $E_{1/2}$ (lux · sec) | $E_{1/10}$ (lux · sec) | $E_{1/2}$ ($\mu J/cm^2$) at 630 nm | $V_{R15}$ (V) | Reflection density |
|---|---|---|---|---|---|---|---|---|---|
| 6 | N—ethylcarbazole | −315 | −299 | 0.95 | 8.0 | 13.0 | 3.0 | −3 | 1.20 |
| 7 | p-dimethylamino-benzoic acid | −326 | −303 | 0.93 | 10.0 | 16.0 | 4.0 | −5 | 1.22 |

EXAMPLES 8 TO 25

Printing plates were prepared as in Example 1 except that the disazo compound (A) was replaced by those which are noted in Table 7. The results of measurement of plate characteristics are summarized in Table 8.

TABLE 7
| Example No. | Disazo Compound |
|---|---|
| 8 | 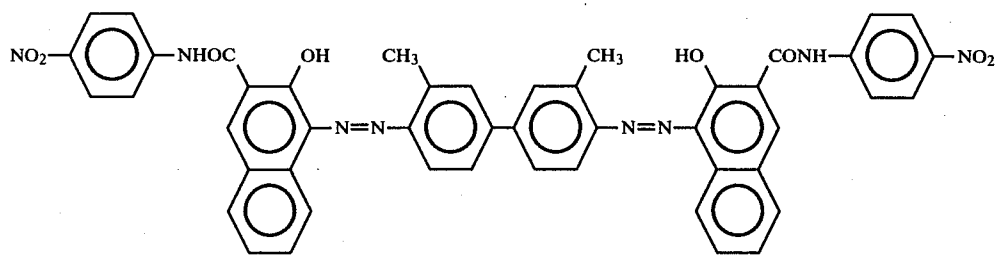 |
| 9 | 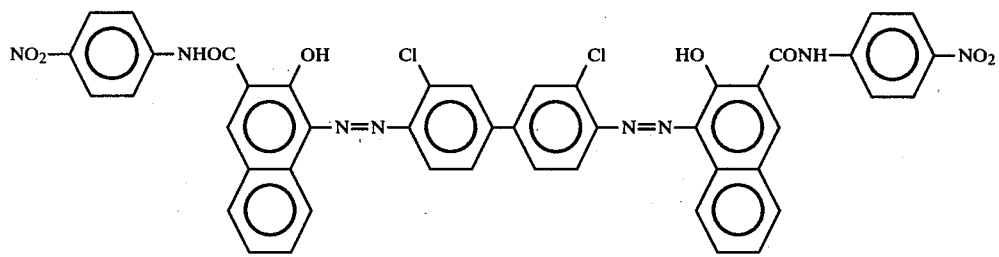 |
| 10 | 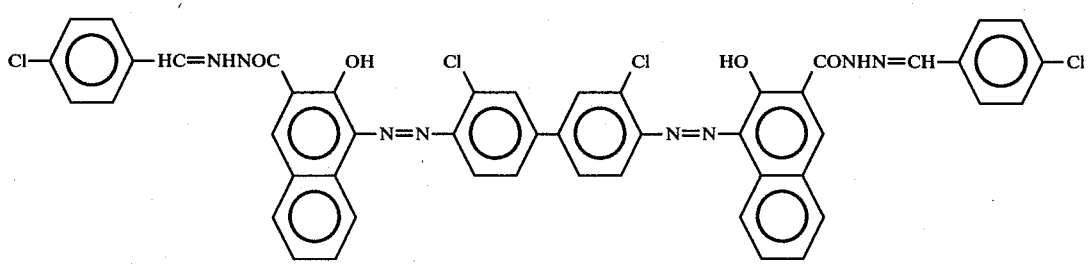 |

TABLE 7-continued
| Example No. | Disazo Compound |
|---|---|
| 11 | 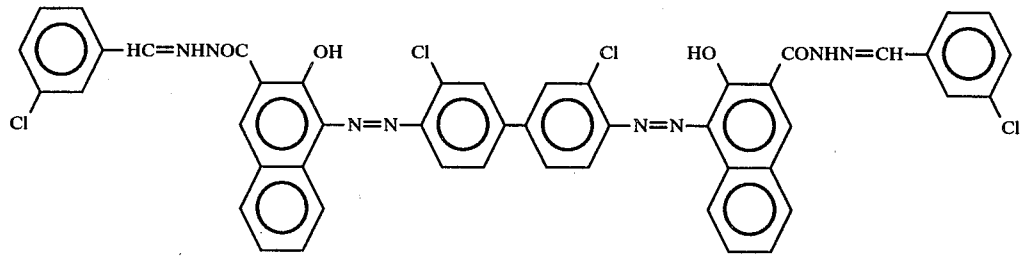 |
| 12 | 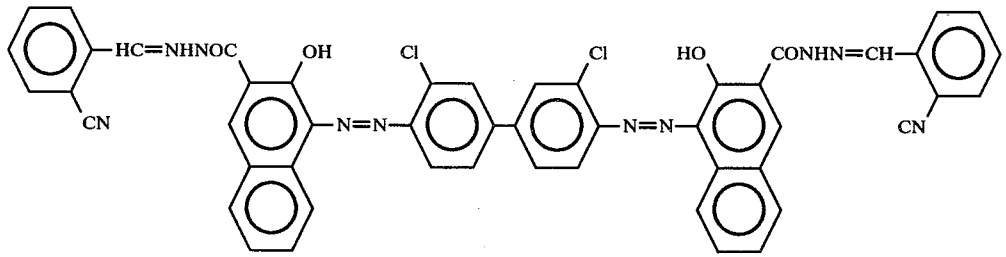 |
| 13 | 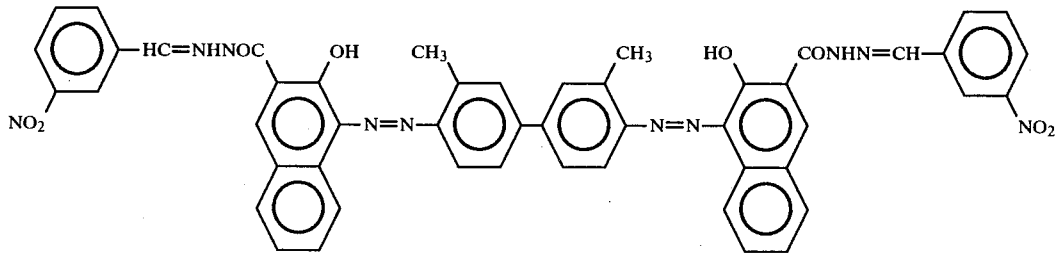 |

TABLE 7-continued
| Example No. | Disazo Compound |
|---|---|
| 14 | 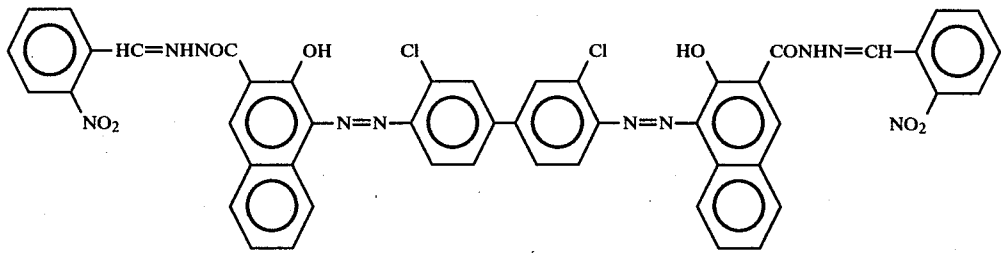 |
| 15 | 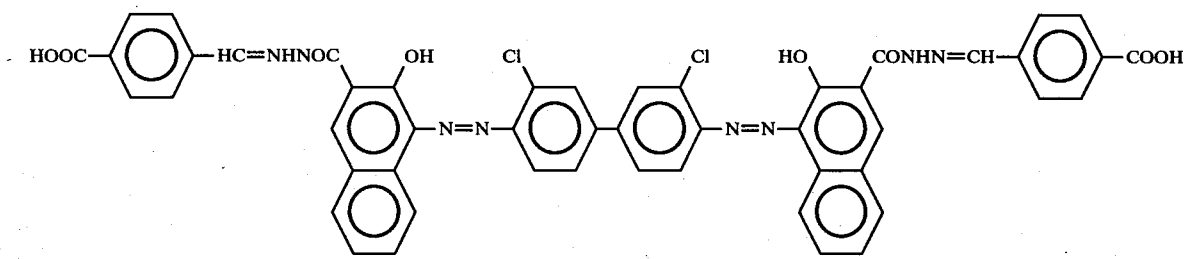 |
| 16 | 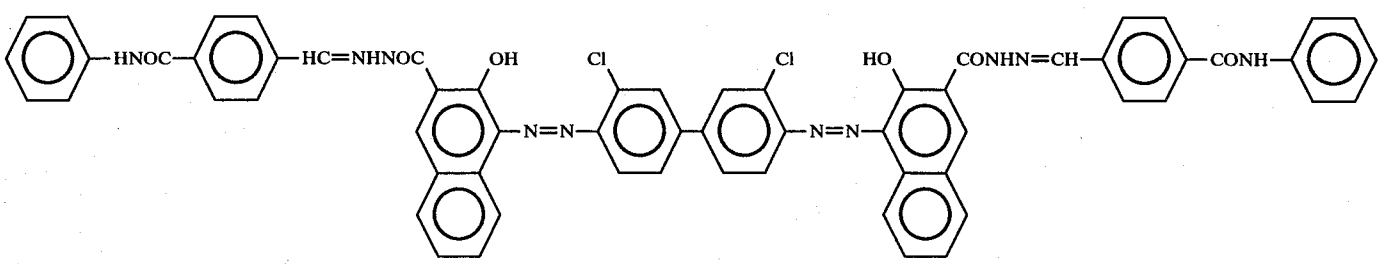 |

TABLE 7-continued
| Example No. | Disazo Compound |
|---|---|
| 17 | 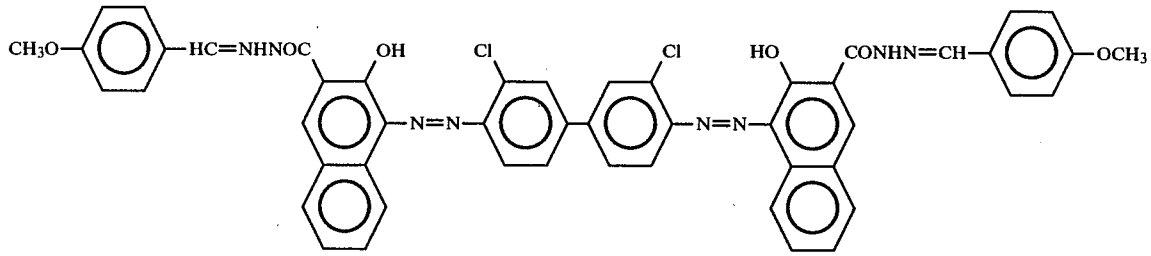 |
| 18 | 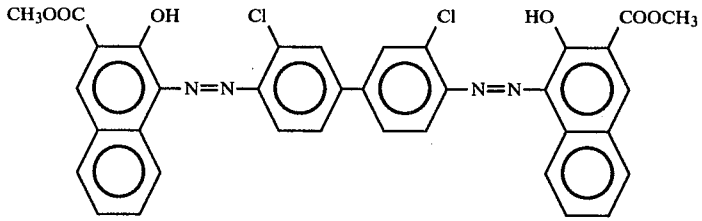 |
| 19 | 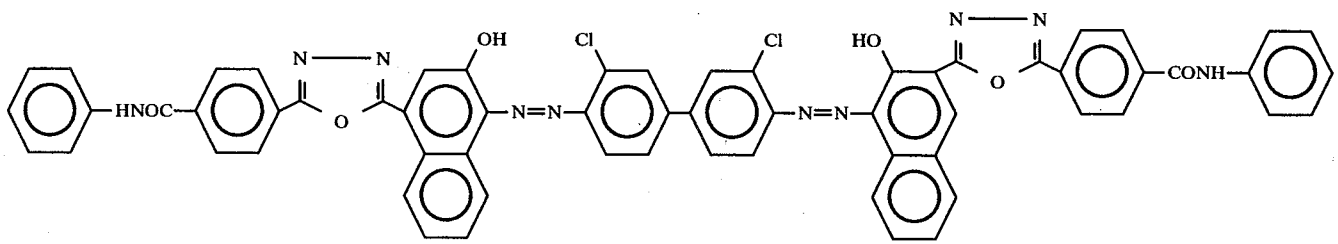 |
| 20 | 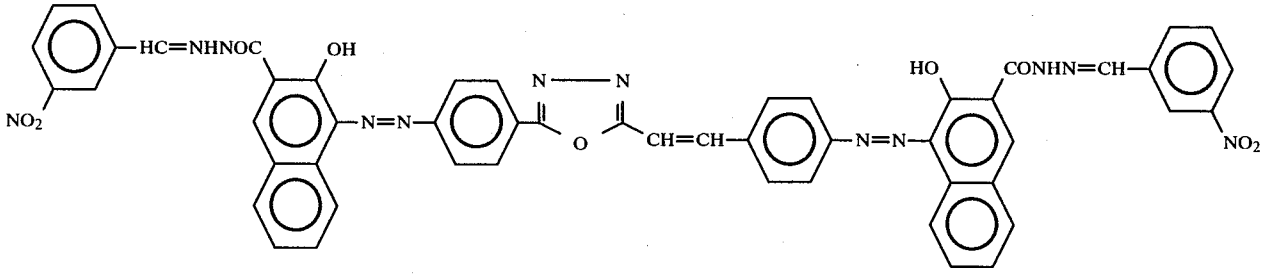 |

TABLE 7-continued
| Example No. | Disazo Compound |
|---|---|
| 21 | 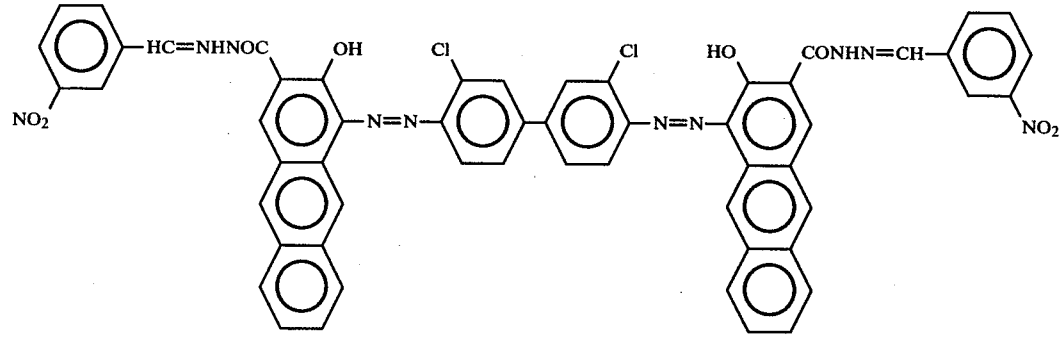 |
| 22 | 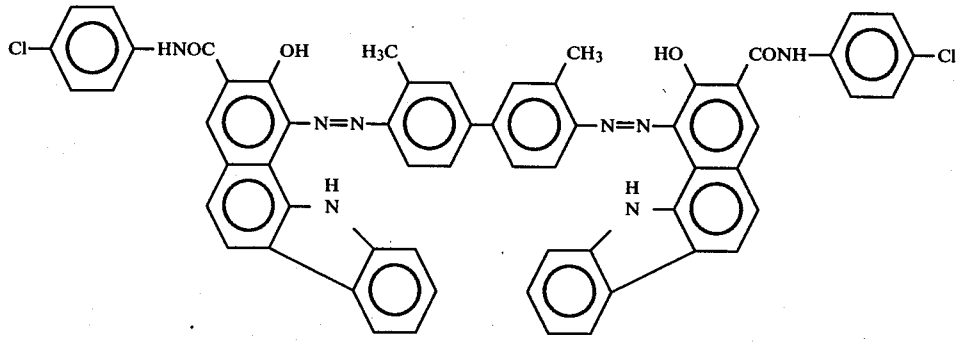 |
| 23 | 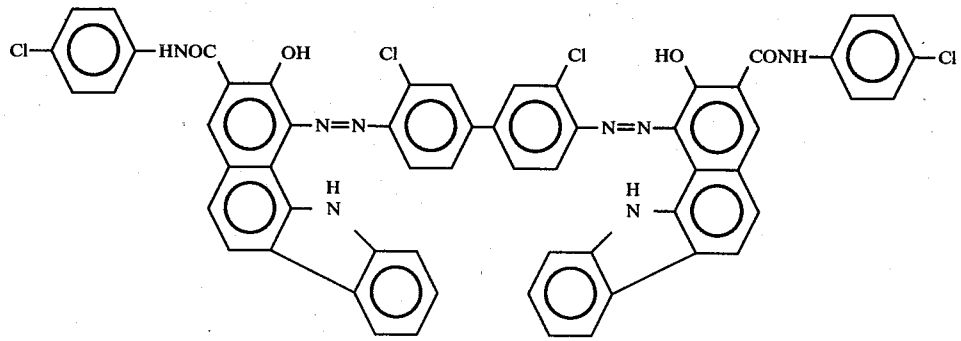 |

TABLE 7-continued
| Example No. | Disazo Compound |
|---|---|
| 24 | 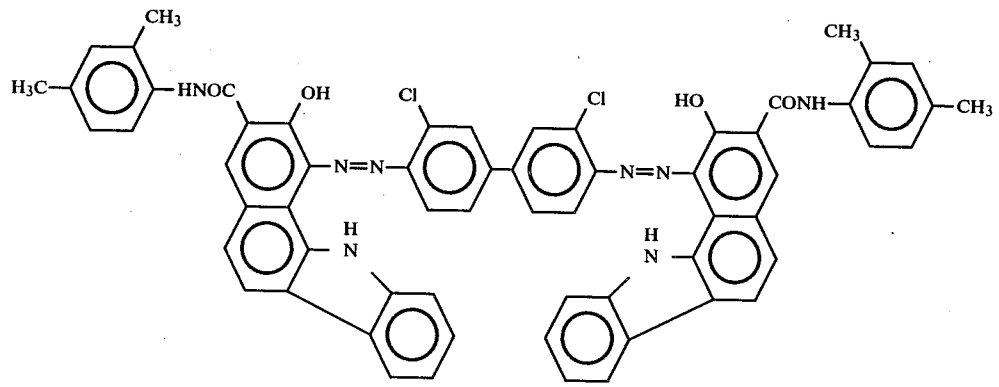 |
| 25 | 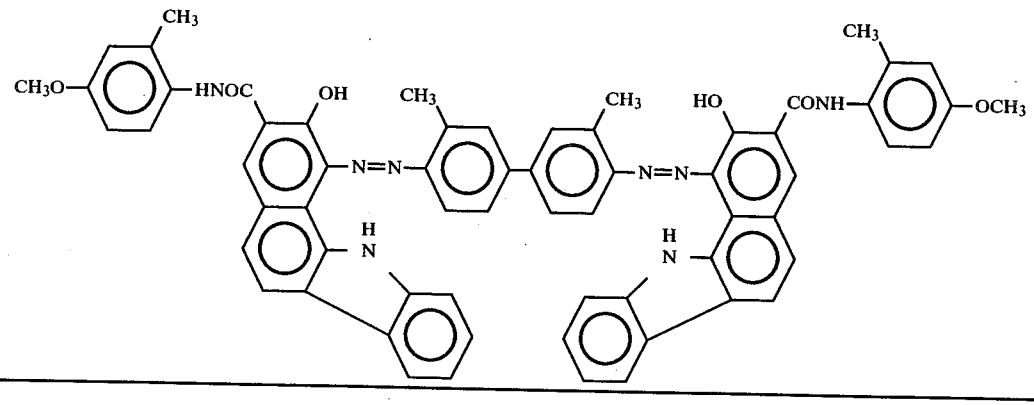 |

TABLE 8

| Example No. | $V_0$ (V) | $V_{10}$ (V) | $V_{10}/V_0$ | $E_{1/2}$ (lux · sec) | $E_{1/10}$ (lux · sec) | $E_{1/2}$ at 630 nm ($\mu J/cm^2$) | $V_{R15}$ (V) | Reflection density |
|---|---|---|---|---|---|---|---|---|
| 8 | −305 | −288 | 0.94 | 10.0 | 20.0 | 5.0 | −5 | 1.20 |
| 9 | −319 | −290 | 0.91 | 7.1 | 18.0 | 3.6 | 0 | 1.18 |
| 10 | −320 | −299 | 0.93 | 7.4 | 16.0 | 3.3 | 0 | 1.20 |
| 11 | −315 | −290 | 0.92 | 9.9 | 21.0 | 5.0 | −6 | 1.17 |
| 12 | −360 | −310 | 0.86 | 10.0 | 21.3 | 4.9 | −5 | 1.17 |
| 13 | −280 | −257 | 0.92 | 9.4 | 21.0 | 4.8 | −7 | 1.15 |
| 14 | −321 | −298 | 0.93 | 7.7 | 15.6 | 3.3 | −2 | 1.20 |
| 15 | −275 | −248 | 0.90 | 9.3 | 16.0 | 3.6 | 0 | 1.21 |
| 16 | −305 | −291 | 0.95 | 8.8 | 15.5 | 3.7 | 0 | 1.09 |
| 17 | −309 | −285 | 0.92 | 7.3 | 16.0 | 3.6 | 0 | 1.22 |
| 18 | −325 | −295 | 0.91 | 10.0 | 19.0 | 4.0 | −2 | 1.18 |
| 19 | −322 | −288 | 0.89 | 10.0 | 20.6 | 4.8 | −3 | 1.17 |
| 20 | −310 | −268 | 0.86 | 7.3 | 15.5 | 3.8 | 0 | 1.15 |
| 21 | −331 | −296 | 0.89 | 6.6 | 10.2 | 3.0 | 0 | 1.20 |
| 22 | −310 | −278 | 0.90 | 5.2 | 12.3 | 3.0 | 0 | 1.16 |
| 23 | −330 | −286 | 0.87 | 9.0 | 20.0 | 4.6 | −2 | 1.17 |
| 24 | −312 | −272 | 0.87 | 10.0 | 19.6 | 4.3 | 0 | 1.17 |
| 25 | −300 | −262 | 0.87 | 9.5 | 21.0 | 4.4 | −1 | 1.20 |

EXAMPLE 26

The printing plate prepared in Example 1 was set in a projection exposure type platemaking machine, "Elefax AP-3W$_{DX}$" (electronic platemaker of Iwatsu Electric Co., Ltd.) and an electrostatic latent image was formed. The latent image was developed by a liquid developer "CBR-101" (Dainippon Ink & Chemicals, Inc.) and the resulting toner image was fixed with an infrared toner fixing machine, "Elefax B35D Heater" (Iwatsu Electric Co., Ltd.). The toner image on the printing plate had a reflection density of 2.3 which was sufficiently higher than the density at the non-image areas (1.2) to provide for easy identification of the toner image. The photoconductive layer in the area where no toner particles were deposited was washed away with an aqueous alkali solution prepared by diluting "Decoating Solution 872" (an alkaline developer of Polychrome Corporation) 12 folds with water. As a result, a lithographic printing plate carrying the toner particles in the image areas was obtained.

This lithographic printing plate was set in a commercial press and more than $10^5$ clean prints were successfully produced.

EXAMPLE 27

The printing plate prepared in Example 1 was set in a laser platemaking machine using a He-Ne laser as a light source and the resulting electrostatic latent image was subsequently developed as in Example 26 to obtain a toner image. There was no detectable deposition of toner particles on the non-image areas and it was found that the printing plate of the present invention had satisfactory sensitivity to exposure by scanning with He-Ne laser light.

The electrophotographic printing plate of the present invention comprises a substrate carrying a photoconductive layer that has (a) a disazo based compound, (b) a perynone based compound and (c) a hole transport material dispersed in (d) an alkali-soluble resin. This plate can be used as a negatively chargeable photoreceptor that has a markedly enhanced sensitivity in the spectral region of visible light and which provides great facility in identification of a toner image.

Therefore, the printing plate of the present invention is useful in a platemaking system employing projection platemaking system for exposure to visible light, a laser platemaking system employing a He-Ne laser as a light source, or a platemaking system using a light-emitting diode as a light source.

While the invention has been described in detail and with reference to specific embodiments thereof, it will be apparent to one skilled in the art that various changes and modifications can be made therein without departing from the spirit and scope thereof.

What is claimed is:

1. An electrophotographic printing plate which comprises a substrate having formed thereon a photoconductive layer comprising (a) a disazo based compound, (b) a perynone based compound, (c) a hole transport material, and (d) an alkali-soluble resin.

2. An electrophotographic printing plate according to claim 1 wherein said disazo based compound is a compound represented by the general formula:

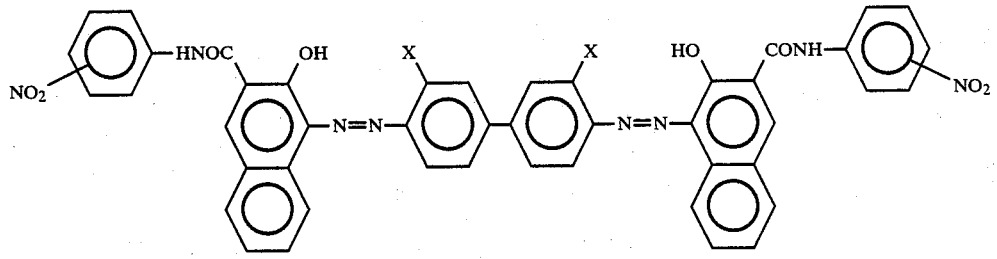

where X is a group or an atom selected from the group consisting of H, $CH_3$, $OCH_3$, Cl and Br.

3. An electrophotographic printing plate according to claim 1 wherein said disazo based compound is a compound represented by the general formula:

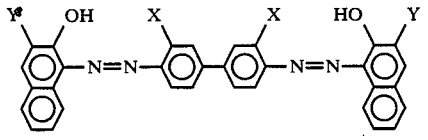

where Y is a group selected from among those which are represented by the following general formulae:

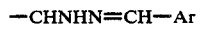

(A)

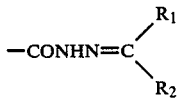

(B)

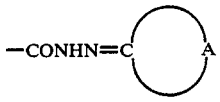

(C)

X is a group or an atom selected from the group consisting of H, $CH_3$, $OCH_3$, Cl, Br and $NO_2$; in formula (A), Ar is a group selected from the group consisting of phenyl, naphthyl, anthryl, pyridyl, thienyl, furyl and carbazolyl groups which may be substituted; in formula (B), $R_1$ and $R_2$ each independently represents an alkyl or aryl group which may be substituted; in formula (C), A C= is a cyclic hydrocarbon group or heterocyclic group which may be substituted

4. An electrophotographic printing plate according to claim 1 wherein said disazo based compound is a compound represented by the general formula:

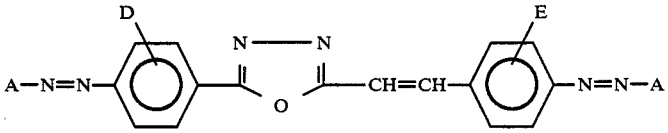

where A is a coupler having aromaticity; D and E each independently represents an atom or a group selected from the group consisting of a hydrogen atom, a halogen atom, a lower alkyl group and a lower alkoxyl group.

5. An electrophotographic printing plate according to claim 1 wherein said disazo based compound is a compound represented by the general formula:

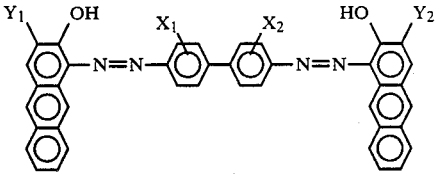

where $X_1$ and $X_2$ each independently represents an atom or a group selected from the group consisting of a hydrogen atom, a halogen atom, an alkyl group, an alkoxyl group and a nitro group; $Y_1$ and $Y_2$ each independently represents a group selected from those having the following general formulae:

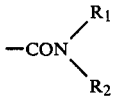

(A)

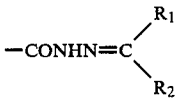

(B)

in formulae (A) and (B), $R_1$ and $R_2$ each independently represents an atom or a group selected from the group consisting of hydrogen atom, a substituted or unsubstituted alkyl group, a substituted or unsubstituted cyclic hydrocarbon group, and a substituted or unsubstituted heterocyclic group; and $R_1$ and $R_2$ may combine together to form a ring.

6. An electrophotographic printing plate according to claim 1 wherein said disazo based compound is a compound represented by the general formula:

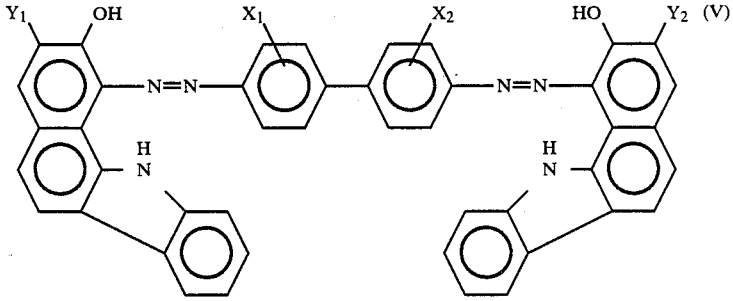

(V)

where $X_1$ and $X_2$ each independently represents an atom or a group selected from the group consisting of a hydrogen atom, and alkyl group, an alkoxyl group and a nitro group; $Y_1$ and $Y_2$ each independently represents a group selected from those which are represented by the following general formulae:

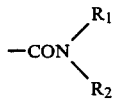

(A)

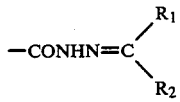

(B)

in formulae (A) and (B), $R_1$ and $R_2$ each independently represents a hydrogen atom, a substituted or unsubstituted alkyl group, a substituted or unsubstituted cyclic hydrocarbon group, and a substituted or unsubstituted heterocyclic group; and $R_1$ and $R_2$ may combine together to form a ring.

7. An electrophotographic printing plate according to claim 1 wherein said perynone based compound is a compound represented by the formula:

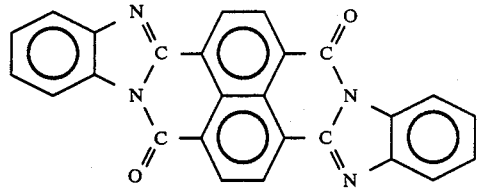

8. An electrophotographic printing plate according to claim 1 wherein said hole transport material is 2,5-bis(4,-diethylaminophenyl)-1,3,4-oxadiazole or N-ethylcarbazole.

* * * * *